US006729054B1

(12) United States Patent
VanderTuin

(10) Patent No.: US 6,729,054 B1
(45) Date of Patent: May 4, 2004

(54) ARTICULATED CONTINUOUS ELECTRONIC DISPLAY

(75) Inventor: Bradley Jon VanderTuin, Brookings, SD (US)

(73) Assignee: Daktronics, Inc., Brookings, SD (US)

( * ) Notice: Subject to any disclaimer, the term of this patent is extended or adjusted under 35 U.S.C. 154(b) by 0 days.

(21) Appl. No.: 10/027,513

(22) Filed: Dec. 19, 2001

(51) Int. Cl.[7] ..... G09F 13/02
(52) U.S. Cl. ..... 40/452; 40/605; 16/236
(58) Field of Search ..... 40/452, 605, 624; 312/7.2; 345/1, 4, 6; 359/443, 451; 16/236, 237

(56) References Cited

U.S. PATENT DOCUMENTS 2,507,857 A * 5/1950 Johnson ..... 40/624
2,602,252 A * 7/1952 Shinn ..... 40/610
2,615,194 A * 10/1952 Kreiner ..... 16/248
2,684,714 A * 7/1954 Corey ..... 160/199
3,608,221 A * 9/1971 Harris ..... 40/605
4,367,000 A * 1/1983 Sparks et al. ..... 312/107
4,566,211 A * 1/1986 Gustafson et al. ..... 40/605
5,128,662 A * 7/1992 Failla ..... 345/1.3
5,347,735 A * 9/1994 Pratt ..... 40/518
5,492,476 A * 2/1996 Ball et al. ..... 434/408
5,768,096 A * 6/1998 Williams et al. ..... 361/681
6,011,545 A * 1/2000 Henderson et al. ..... 345/173
6,262,785 B1 * 7/2001 Kim ..... 349/58
6,353,529 B1 * 3/2002 Cies ..... 361/681
6,377,324 B1 * 4/2002 Katsura ..... 349/58
6,532,147 B1 * 3/2003 Christ, Jr. ..... 361/683

* cited by examiner

*Primary Examiner*—Brian K. Green
(74) *Attorney, Agent, or Firm*—Hugh D. Jaeger

(57) ABSTRACT

Articulated continuous electronic display providing for an electronic display panel bridging between adjacent non-coplanar electronic display sections to provide for continuous non-interrupted alphanumeric or graphic informational display.

1 Claim, 5 Drawing Sheets

ARTICULATED CONTINUOUS ELECTRONIC DISPLAY

CROSS REFERENCES TO CO-PENDING APPLICATIONS

None.

BACKGROUND OF THE INVENTION

1. Field of the Invention

The present invention is for an articulated continuous electronic display, and more particularly is for an electronic display which includes an intermediate electronic display panel articulatingly aligned between electronic displays mounted on surfaces which are not co-planar.

2. Description of the Prior Art

Often, electronic displays, such as those utilizing LEDs (light emitting diodes) or other electrical or electronic display media are incorporated and mounted on adjoining surfaces which are not coplanar. The primary example of this is where the electronic displays are mounted on the fascia at the front of seating levels or in other alocations at arenas and stadiums or other locations where often the fascia members are not coplanar. Such installations included locating of side-by-side display cabinets having alphanumeric or graphic electronic displays on adjacent intersecting fascia, whereby a gap between the sections would visually appear as a black line or jump in the content of the display. Such an effect is unacceptable to the persons viewing the display. Additionally, if the angle of angular juxtaposition of the electronic display sections were lessened, an abrupt visual aberration imparting an illusion of non-linear and interrupted viewing would be perceived by the viewer. Clearly what is needed is a multiple section electronic display that can wrap seamlessly and continuously along non-coplanar fascia so that the content of the display will flow clearly and smoothly without interruption along the entire length. Such is provided for by an articulated continuous electronic display, the present invention.

SUMMARY OF THE INVENTION

The general purpose of the present invention is to provide an articulated continuous electronic display. The articulated continuous electronic display includes groups of one or more electronic display sections mounted on adjacent surfaces which are not co-planar which are joined by an articulated electronic display section bridging across the fascia intersection and between the electronic display sections to form an articulated continuous electronic display.

According to one embodiment of the present invention, there is provided an articulated continuous electronic display including an articulated electronic display section having variable geometry for mounting to groups of flanking and adjacent cabinetized electronic display sections. The variable geometry consists of hinged mounting plates which are slotted for attachment and suitable alignment to the near ends of the adjacent electronic display sections.

One significant aspect and feature of the present invention is an articulated continuous electronic display providing for continuous uninterrupted viewing along non-coplanar mounted electronic display sections.

Another significant aspect and feature of the present invention is an articulated electronic display section having hinged mounting plates which facilitate mounting to adjacent electronic display sections.

Another significant aspect and feature of the present invention is a range of angular adjustability between a centrally located articulated electronic display section and adjacent electronic display sections.

Another significant aspect and feature of the present invention is lateral adjustability of an electronic display panel of an articulated electronic display section with respect to adjacent electronic display panels of adjacent electronic display sections.

Still another significant aspect and feature of the present invention is an articulated continuous electronic display which obviates a black line or jumps between electronic display sections mounted on non-coplanar surfaces.

Yet another significant aspect and feature of the present invention is an articulated continuous electronic display which obviates an abrupt visual aberration imparting an illusion of non-linear and interrupted viewing as would otherwise be perceived by the viewer.

Having thus set forth significant aspects and features of the present invention, it is the principal object of the present invention to provide an articulated continuous electronic display.

BRIEF DESCRIPTION OF THE DRAWINGS

Other objects of the present invention and many of the attendant advantages of the present invention will be readily appreciated as the same becomes better understood by reference to the following detailed description when considered in connection with the accompanying drawings, in which like reference numerals designate like parts throughout the figures thereof and wherein.

DETAILED DESCRIPTION OF THE PREFERRED EMBODIMENTS

Figure 1:
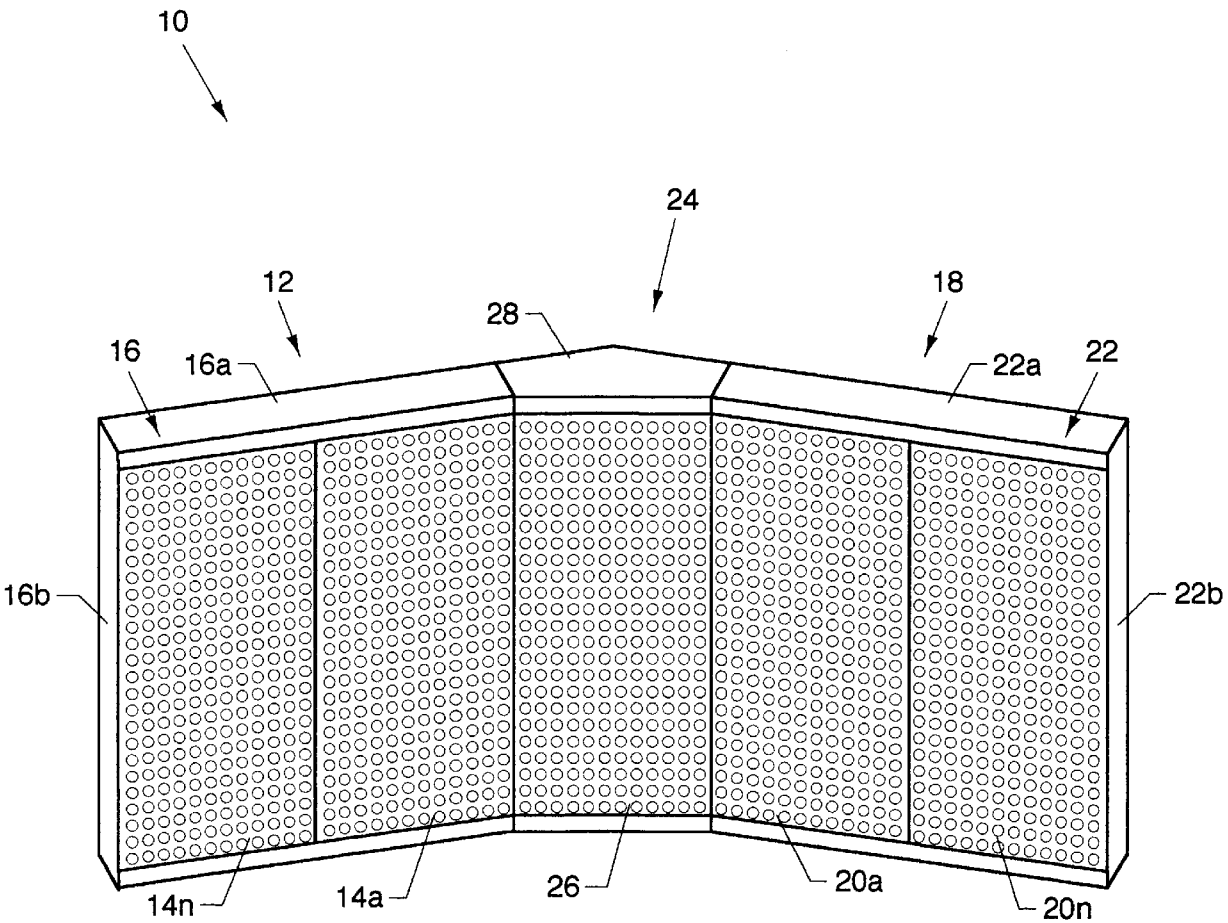
FIG. 1 illustrates a perspective view of an articulated continuous electronic display, the present invention.
Figure 2:
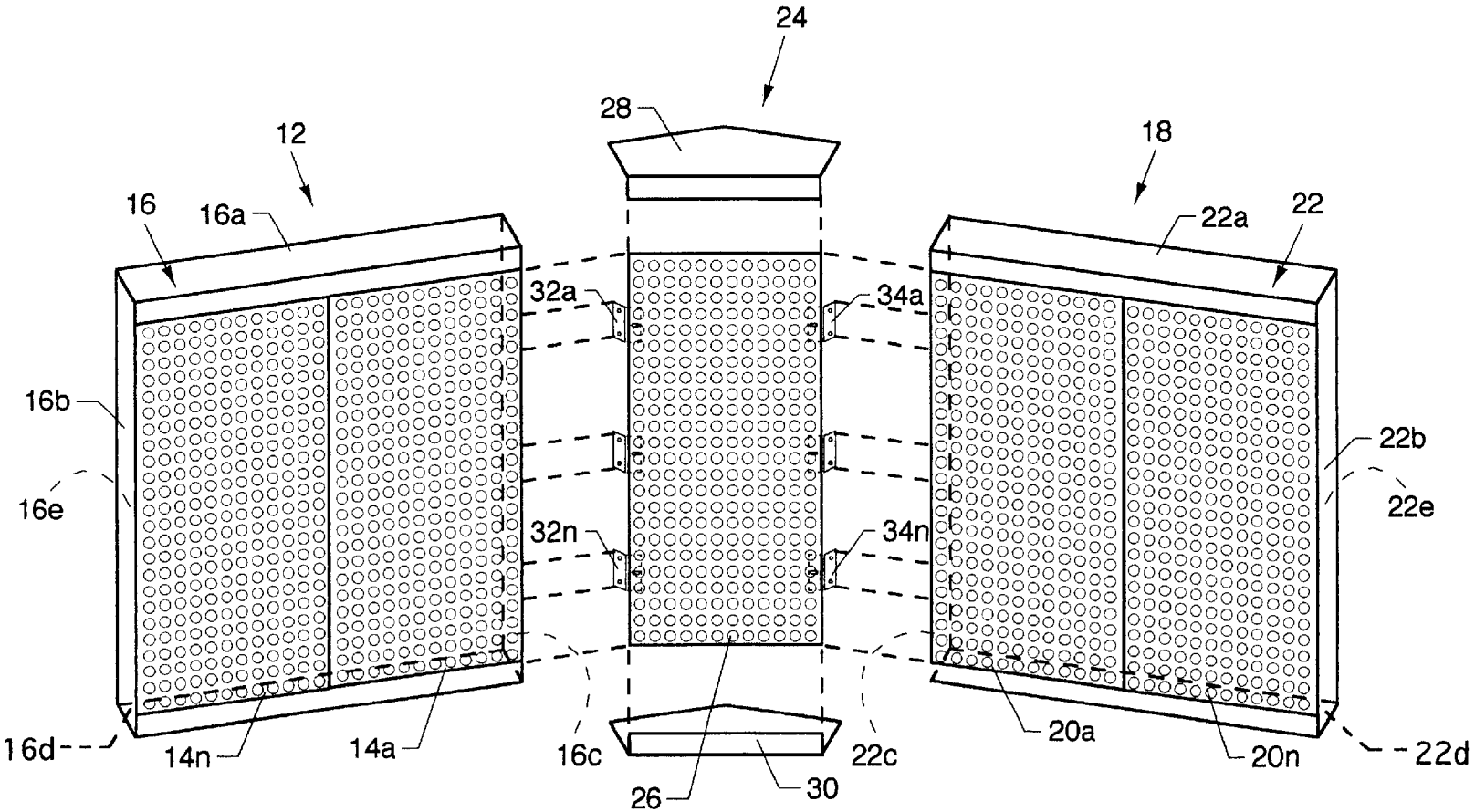
FIG. 2 illustrates a semi-exploded perspective view of the articulated continuous electronic display.

FIG. 1 illustrates a perspective view of an articulated continuous electronic display 10, the present invention. The continuous articulated electronic display 10 includes, in part, an electronic display section 12 of suitable length having a plurality of electronic display panels 14*a*–14*n* secured and mounted in a cabinet 16 having, as best shown in FIG. 2, a top 16*a*, opposing sides 16*b* and 16*c*, a bottom 16*d* and a back 16*e*. The articulated continuous electronic display 10 also includes, in part, an electronic display section 18 of suitable length having a plurality of electronic display panels 20*a*–20*n* secured and mounted in a cabinet 22 having, as best shown in FIG. 2, a top 22*a*, opposing sides 22*b* and 22*c*, a bottom 22*d* and a back 22*e*. An articulated electronic display section 24 including an electronic display panel 26 aligns between and articulatingly connects cabinet 16 of the electronic display section 12 and cabinet 22 of the electronic display section 18. Configured top and bottom panels 28 and 30 (FIG. 2) mate with the articulated electronic display section 24, the top 16*a* of the cabinet 16, the top 22*a* of the cabinet 22, the bottom 16*d* of the cabinet 16 and the bottom 22*d* of the cabinet 22, respectively.

FIG. 2 illustrates a semi-exploded perspective view of the articulated continuous electronic display 10. Illustrated in particular are a plurality of hinges 32*a*–32*n* secured to one side of the articulated electronic display section 24 and a plurality of like hinges 34*a*–34*n* opposingly secured to another side of the articulated electronic display section 24. The hinges 32*a*–32*n* secure by appropriate fasteners to side 16*c* of the cabinet 16 and the hinges 34*a*–34*n* secure by appropriate fasteners to side 22*c* of the cabinet 22 to form an articulated continuous electronic display 10, as shown in FIG. 1.

Figure 3:
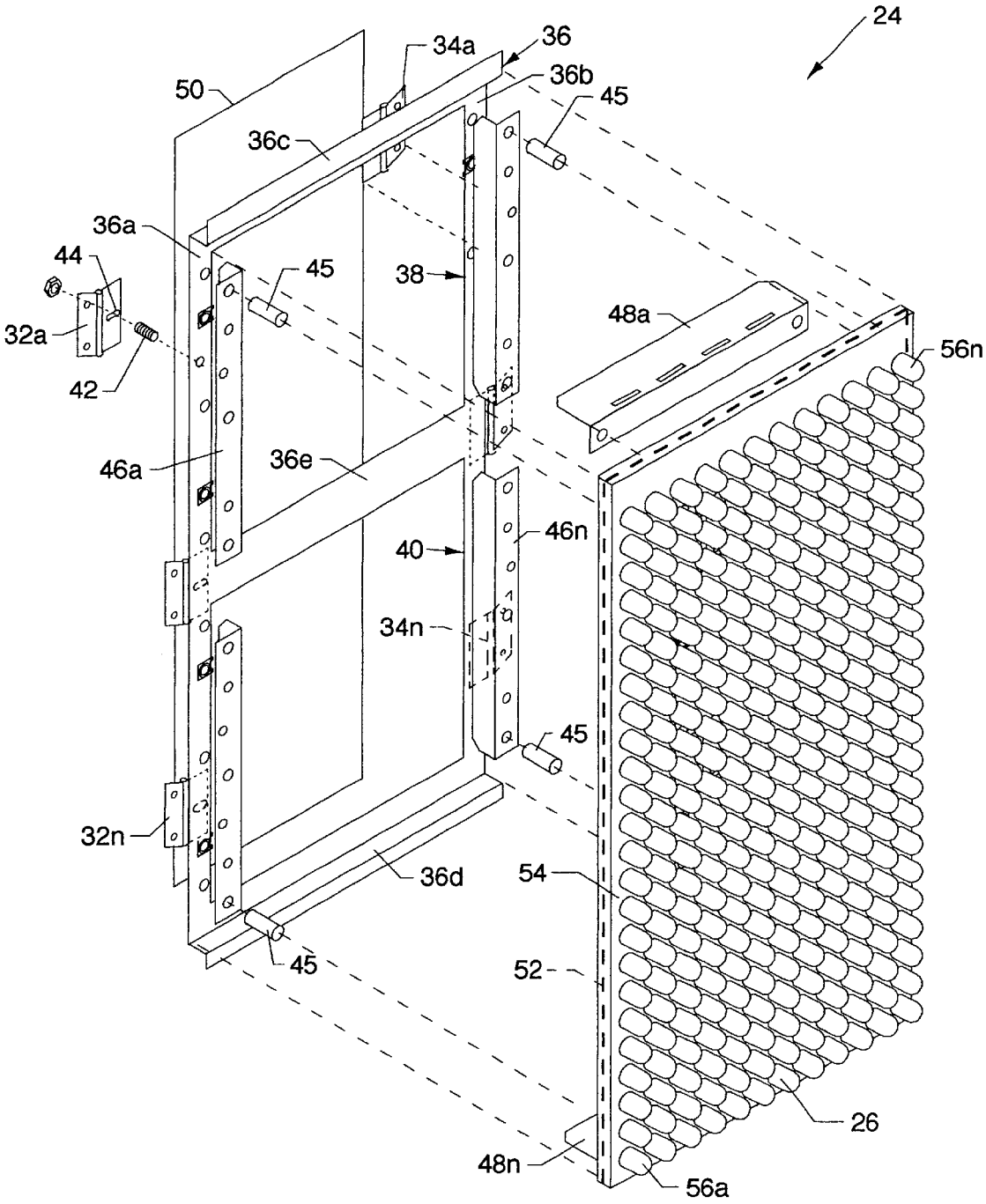
FIG. 3 illustrates an exploded isometric view of an articulated electronic display section.

FIG. 3 illustrates an exploded isometric view of the articulated electronic display section 24. Illustrated in particular is a framework 36 central to and being part of the articulated electronic display section 24 to which a plurality of components secure and attach, thereby completing the articulated electronic display section 24. The framework 36 includes opposing vertically oriented sides 36*a* and 36*b*, opposing horizontally oriented angled sides 36*c* and 36*d* extending between the vertically oriented sides 36*a* and 36*b*, and a horizontally oriented mid-framework member 36*e* the members of which describe upper and lower cutout areas 38 and 40. A plurality of horizontally and rearwardly extending stud mounts 42 secured to the left side 36*a* and the right side 36*b* accommodate a plurality of like hinges 32*a*–32*n* and 34*a*–34*n*, such as illustrated at the upper regions of the sides 36*a* and 36*b*. Each of the plurality of hinges 32*a*–32*n* and 34*a*–34*n* includes a horizontally oriented slot 44 which aligns over and about a stud mount 42 to allow horizontal positional alignment of the hinges 32*a*–32*n* and 34*a*–34*n* with respect to the framework 36 which substantially allows horizontal positioning of the articulated electronic display section 24 to adjacent electronic display sections 12 and 18. Vertically aligned angled rails 46*a*–46*n* align to the frame 36 and extend through the cutouts 38 and 40, respectively. A plurality of horizontally aligned spacers 45 secure between the electronic display panel 26 and the frame 36. Angled rails 48*a*–48*n* secure to and extend from the upper and lower regions of the electronic display panel 26 to connect to a panel 50 shown to the rear of the framework 36. The electronic display panel 26 includes a circuit board 52, shown in dashed lines, a face plate 54, and a plurality of LEDs 56*a*–56*n*, for example, extending through the face plate 54. Although a plurality of LEDs 56*a*–56*n* is illustrated for purposes of illustration and example, any other suitable display media, such as, but not limited to, liquid crystal display (LCD), incandescent lights, flat panel video screens or the like, could be incorporated for informational displays. Other display panels incorporating the principles of the invention can be utilized by dimensional adaptation.

Figure 4:
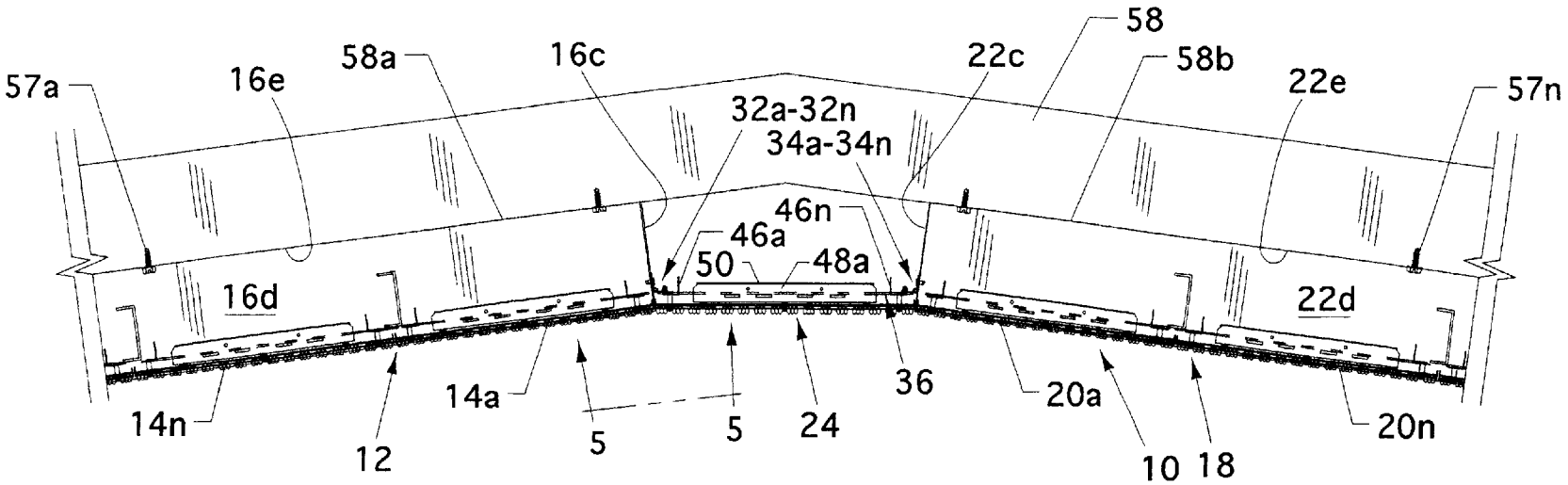
FIG. 4 illustrates a cutaway top view of the articulated continuous electronic display secured to planar surfaces of a fascia; and, FIG. 5 illustrates a section view along line 5—5 of FIG. 4 of the mating of the articulated electronic display section to an electronic display section by hinges.

FIG. 4 illustrates a cutaway top view of the articulated continuous electronic display 10 secured by a plurality of fasteners 57*a*–57*n* to the planar surfaces 58*a* and 58*b* of fascia 58 which are angled with respect to one another. The backs 16*e* and 22*e* of cabinets 16 and 22 are directly secured to the planar surfaces 58*a* and 58*b* of the fascia 58, thereby securing the cabinets 16 and 22 to the fascia 58. The pluralities of hinges 32*a*–32*n* and hinges 34*a*–34*n* secure the articulated electronic display section 24 to the sides 16*c* and 22*c* of the cabinets 16 and 22, respectively, thereby supporting the articulated electronic display section 24 between the cabinets 16 and 22. The pluralities of hinges 32*a*–32*n* and hinges 34*a*–34*n* allow flexibility of the angular relationship of the centrally located articulated electronic display section 24 to the adjoining electronic display sections 12 and 18 located in cabinets 16 and 22.

Figure 5:
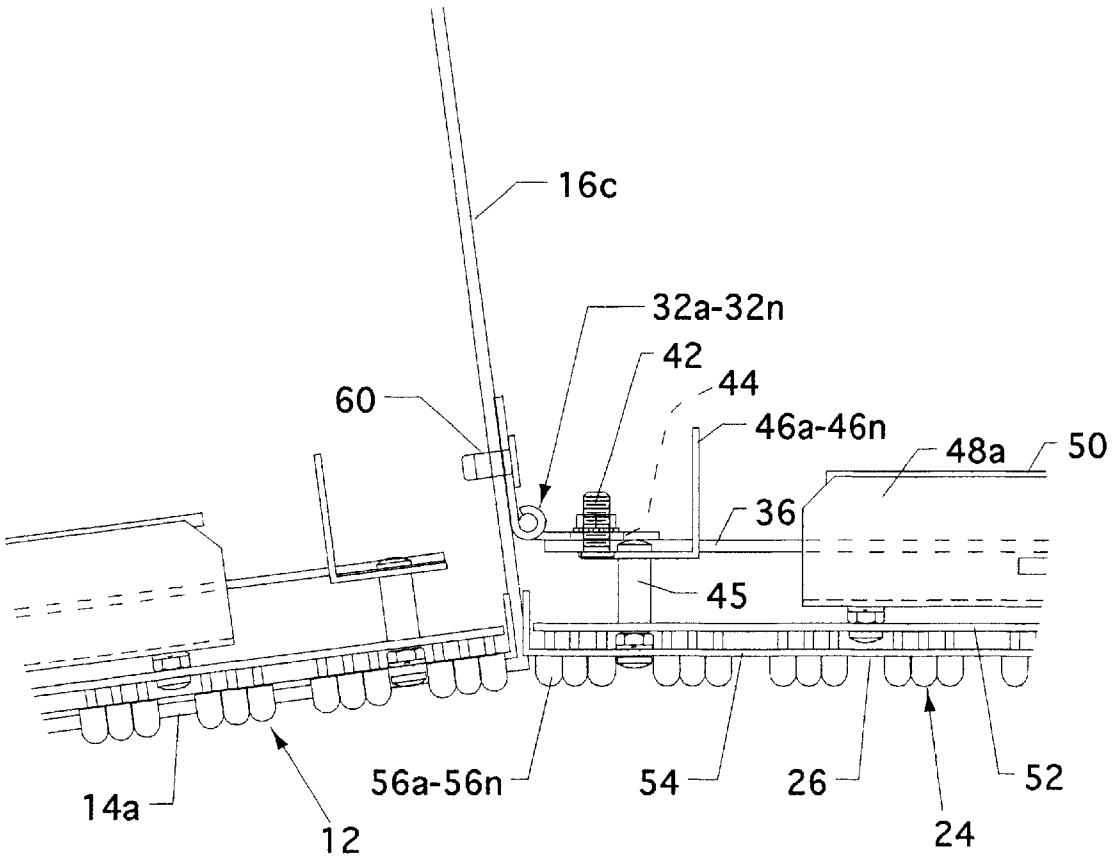

FIG. 5 illustrates a section view along line 5—5 of FIG. 4 of the mating of the articulated electronic display section 24 to the electronic display section 12 by the hinges 32*a*–32*n*. A plurality of suitable fasteners 60 extend through a portion of the hinges 32*a*–32*n* and through the side 16*c* of the cabinet 16, thereby securing the articulated electronic display section 24 to the cabinet 16. The relationship of the articulated electronic display section 24 to the electronic display section 12 can be adjusted in several fashions to provide for best alignment thereof. One such adjustment is provided about the hinges 32*a*–32*n*, whereby the angular relationship of the articulated electronic display section 24 can be adaptively varied to provide perpendicular alignment of the articulated electronic display section 24 to a line bisecting the intersection of the fascia surfaces 58*a* and 58*b*, thereby best determining an angular relationship between the electronic display section 12 and the articulated electronic display section 24 which should substantially be the same as the angular relationship between the electronic display section 18 and the articulated electronic display section 24. Longitudinal left and right adjustment of the articulated electronic display section 24 in order to bring the edge of the electronic display panel 26 into close proximity with one edge of the adjoining edge of the electronic display panel 14a is provided by the positionable relationship of the stud mount(s) 42 extending from the framework 36 through the slot(s) 44 in the hinges 32*a*–32*n*. Rearward or forward positioning of the electronic display panel 26 with relationship to the framework 36 can be accomplished, if desired, by providing differently dimensioned spacers 45, if required. Hinges 34*a*–34*n* provide for similar relationships and adjustability of like components, as previously described for hinges 32*a*–32*n*.

Various modifications can be made to the present invention without departing from the apparent scope hereof.

It is claimed:

1. An electronic display assembly including a bridging electronic display section for articulated interposition between a first cabinetized electronic display section, having an adjacent side, and a second cabinetized electronic display section, having an adjacent side, the second cabinetized electronic display section is separated from and non-coplanar with the first cabinetized electronic display section, the bridging electronic display section comprising:

a framework, the framework having a first vertically oriented side with a hinged mounting plate which is slotted for attachment and alignment with the adjacent side of the first cabinetized electronic display section and a second vertically oriented side with a hinged mounting plate which is slotted for attachment and alignment with the adjacent side of the second cabinetized electronic display section such that the framework nay be held in a non-coplanar relationship relative to the first and second cabinetized electronic display sections, and b. an electronic display mounted on the framework, the electronic display assuming a non-coplanar relationship with the first and second cabinetized electronic display sections when the framework is held by the hinged mounting plates between the first and second cabinetized electronic display sections;

the first and second cabinetized electronic display sections are attached to a fascia;

the fascia includes a first fascia surface, the first cabinatized electronic display section being mounted to the first fascia surface, and further includes a second fascia surface, angularly distinct from the first fascia surface, the second cabinetized electronic display section being mounted to the second fascia surface;

the framework adjoins the first and second fascia surfaces; and, the framework is held in adjoining contact with the first and second fascia surfaces by the hinge mounting plates.

* * * * *